United States Patent [19]

Lirakis

[11] 4,121,688

[45] Oct. 24, 1978

[54] SAFETY HARNESS FOR LIMITED MOBILITY

[76] Inventor: Warren Stephen Lirakis, Moorland Farm, Newport, R.I. 02840

[21] Appl. No.: 737,393

[22] Filed: Nov. 1, 1976

Related U.S. Application Data

[63] Continuation-in-part of Ser. No. 621,635, Oct. 8, 1975, abandoned.

[51] Int. Cl.[2] ..... A62B 1/16; A47L 3/04

[52] U.S. Cl. ..... 182/3

[58] Field of Search ..... 182/3, 4, 5, 6, 7

[56] References Cited

U.S. PATENT DOCUMENTS

| | | | |
|---|---|---|---|
| 1,409,702 | 3/1922 | Gill | 182/3 |
| 3,258,788 | 7/1966 | Anciaux | 182/3 |

*Primary Examiner*—Reinaldo P. Machado

[57] ABSTRACT

A safety harness comprising a body embracing strap which extends over the shoulders and about the chest of the wearer with a tether to attach to some fixed structure allowing the wearer to move limited distances therefrom with both arms free such as might be used by a yachtsman, window washer or mountain climber.

2 Claims, 8 Drawing Figures

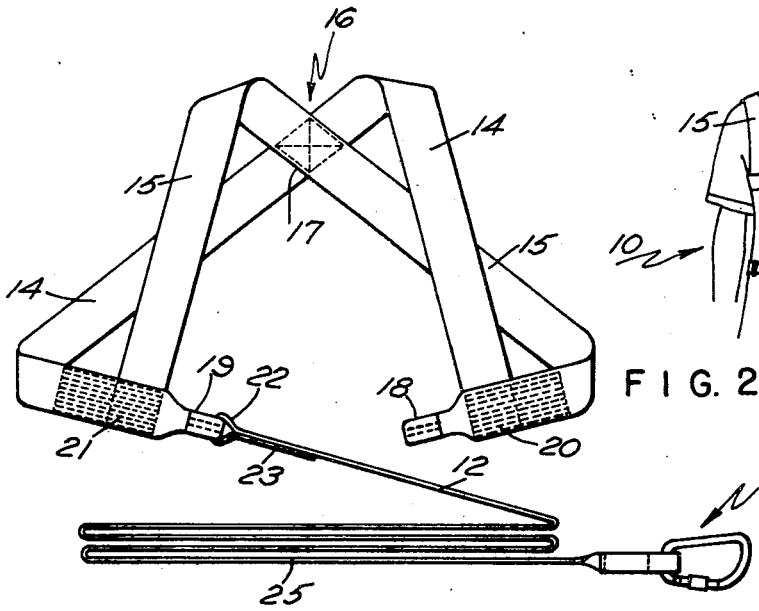
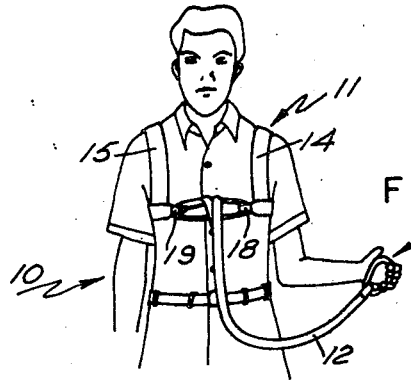
FIG. 1
FIG. 2
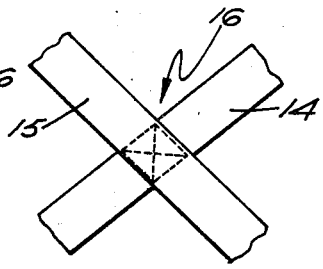
FIG. 3
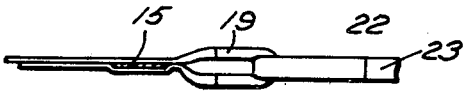
FIG. 4
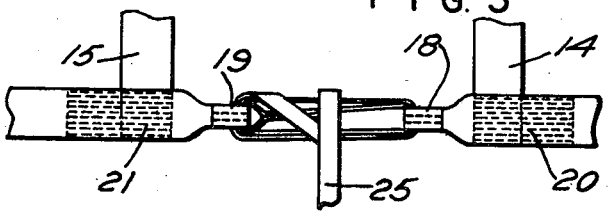
FIG. 5
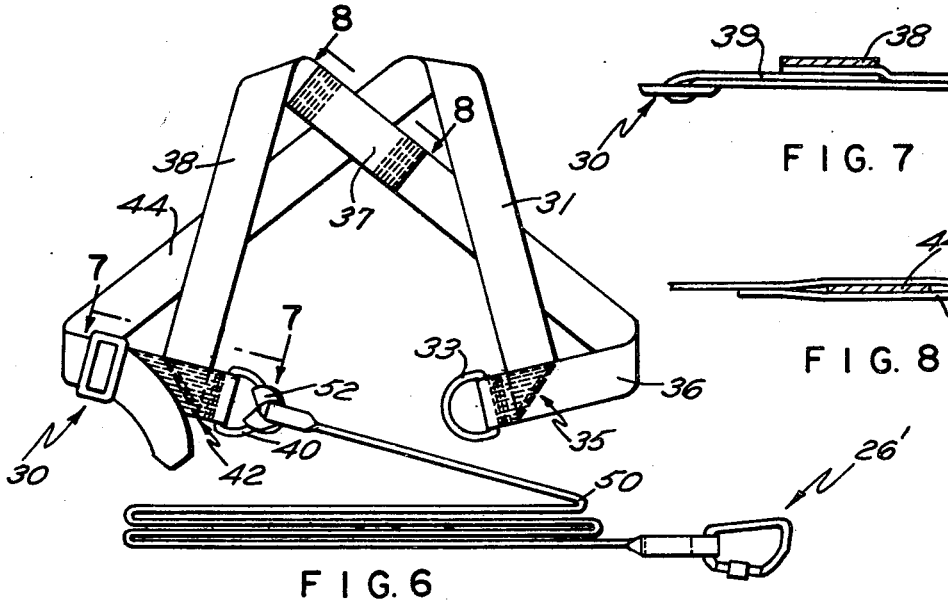
FIG. 6
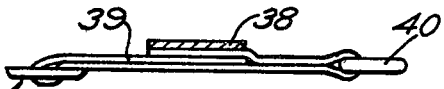
FIG. 7
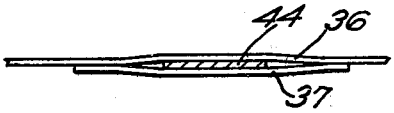
FIG. 8

SAFETY HARNESS FOR LIMITED MOBILITY

CROSS REFERENCE TO RELATED APPLICATION

This application is a continuation-in-part of my earlier filed application Ser. No. 621,635 filed Oct. 8, 1975, now abandoned.

BACKGROUND OF THE INVENTION

The term safety harness may refer in some instances to the securing of a person in a seat such as in an automobile or airplane but in this particular instance the term refers more particularly to a harness with a rope or tether to be secured to a relatively fixed point and yet allow limited movement of the person. If used in yachting, the person would be attached to the boat leaving both arms free for working on the boat, the tether serving to hold the person should he slip or be struck by a wave so that he will not be washed overboard. In mountain climbing the tether may be used for securing to some hook or the like for use in ascent or descent of the mountain. In the case of window washing the tether would be secured to the framework of the window of the building in case of slipping of the user. Devices of this sort usually are of the type with a body encircling belt and two shoulder straps secured to such belt in front and in back as in U.S. Pat. No. 1,481,144 where no tether is shown or in a case where a tether is used as shown in U.S. Pat. No. 2,817,393 the device is more complicated and expensive than the present disclosure.

SUMMARY OF THE INVENTION

The safety harness of this invention comprises essentially strap portions and a tether which is used for securing a frontal portion of the strap together and about the body of the wearer. The strap portions are crossed and either secured to each other at a point which will be located at the back of the wearer or one guided through a loop in the other portion and from this point of crossing the strap portions lead downwardly in opposite directions and around the body of the user to a point adjacent each other at the front of the user while the strap portions extend in the other direction from the point of crossing one over each shoulder of the user and vertically downward. The strap portions are each provided with a loop at their frontal point of meeting when in place on a user and a tether secured to one of the loops is threaded through the other loop and back and forth as much as desired to secure the straps together in the front of the user and also serve to take up a part of the length of the tether while allowing an extent of the tether for securing to some relatively fixed object or point of attachment.

DESCRIPTION OF THE DRAWINGS

FIG. 1 is an elevational view showing a person with a harness positioned on his body and holding one end of the tether in one hand;

FIG. 2 is a perspective view of the safety harness alone;

FIG. 3 is a fragmental view showing a point of crossing of straps and a stitching of the straps together at such point of crossing;

FIG. 4 is a sectional view looking down on top of one of the loops to which the tether is attached;

FIG. 5 is a fragmental view on a larger scale than that shown in FIG. 1 showing the tether as securing the ends of the straps together;

FIG. 6 is an elevational view showing the safety harness and tether;

FIG. 7 is a sectional view taken on lines 7—7 of FIG. 6 showing the folding at the front terminal portion;

FIG. 8 is a sectional view taken on lines 8—8 of FIG. 6 showing the manner in which the straps are retained in approximate position relative to each other in the portion that would normally lie in the back of the wearer.

DESCRIPTION OF THE PREFERRED EMBODIMENT

In FIG. 1 the person of the wearer is designated generally 10 and the safety harness 11 worn by the wearer and comprising the body embracing straps and a tether 12 extending therefrom.

In FIG. 2 where the safety harness is shown by itself there are two straps 14 and 15 which cross each other as at 16 and are sewed to each other as shown by the dotted lines 17 so that they are held together at their point of crossing. The strap 15 extends from its point of crossing downwardly and then inwardly about the left side of the user as shown in FIG. 2 and is provided with a loop 18 at its end while the strap 14 extends downwardly and inwardly about the right side of the user with a loop 19 at its end. The end portions of the straps having these loops extend toward each other in front of the user and may be laced together by the tether 12 as will be more fully explained below. The strap 14 extends upward in the opposite direction from the crossing at 16 over the left shoulder of the wearer and then vertically downward and is attached by sewing as at 20 to the strap 15 adjacent the loop 18, while the strap 15 extends upward in its opposite direction from the point 16 of crossing over the right shoulder of the wearer and then vertically downward and is attached by sewing to the strap 14 adjacent the loop 19 as at 21. The loops 18, 19 may, if desired, be separate parts attached to the ends. This arrangement provides for the straps 14 and 15 to extend over each of the shoulders of the wearer as well as about the body of the wearer to the front of the wearer where the wearer may use the tether 12 which is secured by the loop 22 to the eye 19, as shown in FIG. 2, by being double back on itself and fastened as at 23 and then the free end of the tether 12 is passed through the loop 18 back and forth in loop 19 a number of times as shown in FIG. 5 and then about the laced portion between the loops with a portion 25 extending to a hook of any form 26 which may be used for attaching it to a lifeline in a sailing vessel, a hook in mountain climbing or a window frame if worn by a window washer.

From the foregoing it will be apparent that two straps such as 14 and 15 of a width much greater than their thickness may be utilized as the main portion of the safety harness forming two shoulder straps and a horizontal body embracing portion while the tether to secure together the ends of these straps which embrace the body of the user may be used as a device for holding the person from being detached from some fixed point should he slip or be accidentally dislodged in any manner from his footing. It still allows the use of both arms for work, while wearing the safety harness. The device cannot be tangled, is self-adjusting as to body encricling size, is simple, positive and inexpensive.

In FIGS. 6, 7 and 8 there is illustrated another form of the invention in which a single strap is wound about in the same pattern as the strap arrangement of FIG. 2 and which is lieu of having two straps with four ends, a single strap has two ends. The design is basically the same that is in a figure 8 and being constructed of one continuous piece of webbing or other strap material it may be adjusted by providing any suitable arrangement such as a buckle, generally designated 30, in FIG. 6. The strap is made up of a number of strap portions and it can be considered that there is a frontal portion 31 which extends downwardly from the shoulder of the wearer, is folded at a 45° angle and thence passes about a D ring 33 and back on itself where it is stitched as at 35. The strap waist portion 36 thence extends about the body of the wearer and upwardly across the back where a loop is formed on the surface of the strap by stitching a flat piece 37 thereto (see FIG. 8). A strap portion 36 thence passes over the shoulder of the wearer and forms a second frontal portion 38 which passes downwardly, is folded at 45° and extends at right angles, thence thru a D ring 40 and back on itself, thence about the center bar of the buckle 30 and again back on itself at 39 where it terminates and is stitched as indicated generally at 42. Likewise the other frontal portion 31 passes up over the shoulder of the wearer, thence thru a loop formed between the portions 36 and 37, and down across the back becoming portion 44 and thence about the right side of the body of the user to the buckle 30 which provides a size adjustment.

In like fashion to the embodiment described above, a tether which as illustrated consists of a line or a section of webbing or the like 50 with a loop in the end thereof designated 52 which loop is passed through itself and around the D ring 40, the entire tether terminating in a suitable clasp or hook or other fastening arrangement generally designated 26'.

From the foregoing it will be apparent that this embodiment is a piece of strong and flexible harness webbing that is sewn at a portion to make a turn about a frontal fastening ring and this minimizes the risk of failure of the stitching under severe stress.

I claim:

1. A safety harness for limited mobility of the person wearing the same comprising strap portions of a width greater than their thickness arranged in crossing relation for positioning against the back of the user and each of a length from the point of crossing to extend in one direction from said point of crossing about the body of the user and approach each other in opposite directions in the front of the user, loops at the frontal portion of each said strap portion, said strap portions extending from the point of crossing in the opposite directions, each of a length to extend over one shoulder of the user to a point adjacent one of said loops, means to secure the ends of said strap portions together at a point adjacent at least one of said loops, means to secure the loops to each other comprising a tether of extended length having one end secured adjacent one of said loops with the other end free and an attaching device secured to the free end, said loops and the free end of said tether being so relatively sized that the free end of the tether may be passed through said loops whereby the tether is passed through the other of said loops and thence through said one loop in a sufficient number of times to provide a selected length adapted to be fastened to an object.

2. A safety harness as in claim 1 wherein the strap portions are secured together at their point of crossing.

* * * * *